US008388409B2

(12) United States Patent
Nakao et al.

(10) Patent No.: US 8,388,409 B2
(45) Date of Patent: Mar. 5, 2013

(54) SUBSTRATE POLISHING APPARATUS

(75) Inventors: Hidetaka Nakao, Tokyo (JP); Yasumitsu Kawabata, Tokyo (JP); Yoshifumi Katsumata, Tokyo (JP); Naoki Ozawa, Tokyo (JP); Tatsuya Sasaki, Tokyo (JP); Atsushi Shigeta, Kanagawa-ken (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 282 days.

(21) Appl. No.: 12/700,917

(22) Filed: Feb. 5, 2010

(65) Prior Publication Data

US 2010/0151770 A1 Jun. 17, 2010

Related U.S. Application Data

(62) Division of application No. 11/013,912, filed on Dec. 17, 2004, now abandoned.

(30) Foreign Application Priority Data

Dec. 19, 2003 (JP) ..... 2003-422857
Jul. 16, 2004 (JP) ..... 2004-209574

(51) Int. Cl.
*B24B 51/00* (2006.01)

(52) U.S. Cl. ..... 451/5; 216/88; 156/345.12; 156/345.13

(58) Field of Classification Search ..... 156/345.12, 156/345.13; 451/5; 216/88
See application file for complete search history.

(56) References Cited

U.S. PATENT DOCUMENTS

| | | | | |
|---|---|---|---|---|
| 5,240,552 | A | 8/1993 | Yu et al. | |
| 5,695,601 | A | 12/1997 | Kodera et al. | |
| 6,264,533 | B1 | 7/2001 | Kummeth et al. | |
| 6,361,406 | B1 | 3/2002 | Ohta | |
| 6,361,646 | B1 | 3/2002 | Bibby, Jr. et al. | |
| 6,534,328 | B1 | 3/2003 | Hewett et al. | |
| 7,247,080 | B1 | 7/2007 | Bennett et al. | |
| 7,252,575 | B2 | 8/2007 | Kobayashi et al. | |
| 7,294,039 | B2 * | 11/2007 | Swedek et al. | 451/5 |
| 8,070,909 | B2 * | 12/2011 | Shanmugasundram et al. | 156/345.13 |
| 2010/0151770 | A1 * | 6/2010 | Nakao et al. | 451/5 |

FOREIGN PATENT DOCUMENTS

| | | |
|---|---|---|
| JP | 7-100297 | 11/1995 |
| JP | 10-106984 | 4/1998 |
| WO | 98/05066 | 2/1998 |
| WO | 99/23449 | 5/1999 |

OTHER PUBLICATIONS

European Search Report issued Apr. 26, 2005 in corresponding EP Application No. 04 030 032.
European Search Report issued Feb. 3, 2006 in corresponding EP Application No. 04 030 032.

* cited by examiner

*Primary Examiner* — Sylvia R. MacArthur
(74) *Attorney, Agent, or Firm* — Wenderoth, Lind & Ponack, L.L.P.

(57) ABSTRACT

A substrate polishing apparatus is provided for preventing excessive polishing and insufficient polishing, and enabling a quantitative setting of an additional polishing time. The substrate polishing apparatus comprises a mechanism for polishing a substrate to be polished; a film thickness measuring device for measuring the thickness of a thin film deposited on the substrate; an interface for entering a target thickness for the polished thin film; a storage area for preserving past polishing results; and a processing unit for calculating a polishing time and a polishing rate. The substrate polishing apparatus builds an additional polishing database for storing data acquired from the result of additional polishing in the storage area.

8 Claims, 9 Drawing Sheets

SUBSTRATE POLISHING APPARATUS

This application is a divisional of U.S. application Ser. No. 11/013,912, filed Dec. 17, 2004 now abandoned.

BACKGROUND OF THE INVENTION

The present invention relates to a substrate polishing apparatus for polishing a substrate such as a semiconductor wafer for planarization.

In recent years, with increasingly miniaturized semiconductor devices, more complicated device structures, and an increase in the number of multi-layer wiring layers of logic systems, semiconductor devices tend to include increasingly more ruggedness and increasingly larger steps. This is because the manufacturing of semiconductor devices involves multiple repetitions of steps for forming a thin film, micro-machining the thin film for patterning and forming aperture therethrough, and forming a next thin film.

Increased ruggedness on the surface of a semiconductor device tends to cause a failure in producing acceptable products and a reduction in yield rate due to a smaller thickness of a thin film at steps during a thin film formation, open circuits due to disconnected wires, and short-circuiting due to defective insulation between wiring layers. Also, even if such products normally operate in an initial stage, they will experience a problem of reliability for long-term use. Further, in an exposure in a lithography step, the ruggedness on an irradiated surface would cause a lens in an exposure system to partially defocus, thus making more difficult the formation of miniature patterns themselves as ruggedness are increased on the surface of the semiconductor device.

Thus, in the semiconductor device manufacturing process, increasingly more importance is being placed on the planarization techniques for planarizing the surface of a semiconductor device. Among the planarization techniques, chemical mechanical polishing (CMP) is regarded as the most important technique. The chemical mechanical polishing employs a polishing apparatus to polish a substrate such as a semiconductor wafer brought into sliding contact with a polishing surface of a polishing pad or the like while supplying a polishing liquid including grinding grains made of silica ($SiO_2$) or the like on the polishing surface.

This type of polishing apparatus comprises a polishing table having a polishing surface including a polishing pad; and a substrate holder, referred to as a "top ring," a "carrier head" or the like for holding a semiconductor wafer. For polishing a semiconductor wafer using such a polishing apparatus, the semiconductor wafer is held by the substrate holder, while the semiconductor wafer is pressed onto the polishing table with a predetermined pressure. In this event, the polishing table and substrate holder are moved relative to each other to bring the semiconductor wafer into sliding contact with the polishing surface, thus polishing the surface of the semiconductor wafer into a flat and mirror-like surface.

In the polishing apparatus described above, when a polishing rate is constant, a polishing amount is proportional to a polishing time (processing time). Thus, the following method has conventionally been employed for determining a polishing time. Specifically, the thickness of one semiconductor substrate is measured before polishing. Then, the one semiconductor substrate is polished by a polishing apparatus for a predetermined constant time, and the thickness of the polished substrate is measured. The polishing rate is calculated from the relationship between the thickness and a required polishing time to determine an appropriate polishing time from a relationship between the polishing rate and a target thickness. Then, subsequent semiconductor substrates are polished for the calculated polishing time (see, for example, Japanese Patent No. 3311864, and Laid-open Japanese Patent Application No. 10-106984).

However, when the polishing rate thus calculated is simply applied as the basis for calculating a polishing rate for a substrate to be polished next, the polishing rate varies. If the polishing rate is limited only to one substrate, the thicknesses of substrates to be subsequently processed will largely deviate from a target value. To address this problem, a proposal has been made to save polished amounts and polishing times of semiconductor substrates which have already undergone the polishing, calculate an average polishing rate from these data, and polish a next substrate based on the average polishing rate (see, for example, Japanese Patent Publication No. 7-100297). This approach of calculating an average polishing rate based on past data provides the advantage of eliminating efforts of measuring the polishing rate from one lot to another and reducing variations in measurements.

However, when a polishing method (for example, see Laid-open Japanese Patent Application No. 8-22970) for improving the capability of eliminating ruggedness is employed for accommodating further miniaturization of semiconductor devices, the polishing rate used in a former polishing process largely differs from that used in a latter polishing process, resulting in a reduction by half of the meaning of the average polishing rate calculated in the aforementioned manner. Specifically, when the polished result shows excessive polishing or insufficient polishing, the processing time should be corrected in consideration of the polishing time at the tail end of polishing, and the use of the average polishing rate makes it difficult to calculate an optimal polishing time.

When the polished result shows insufficient polishing, additional polishing (i.e., rework) is involved, leading to an increased manufacturing cost. In addition, a polishing time in the additional polishing is set based on the experience of an operator. On the other hand, when the polished result shows excessive polishing, Cu layers within grooves for wiring will be polished away together with insulating films to cause an increased circuit resistance, in which case the overall semiconductor substrate must be discarded, resulting in a lower yield rate and a huge loss.

In some conventional substrate polishing apparatus, STI (shallow trench isolation) CMP is performed for forming device isolation by shallow trench isolation. In the STI CMP, after completely removing an $SiO_2$ film deposited on the uppermost layer of a substrate, an underlying SiN layer is polished by a predetermined thickness before the polishing is finished. In this event, a method of sensing that the overlying $SiO_2$ layer has been removed, known in the art, involves measuring a current of a motor for driving a top ring or a turn table, and utilizing a change in the current when a torque changes due to a transition of materials from $SiO_2$ to SiN. However, this method implies a problem in that the operator's experience must be relied on to determine an over-polishing time for polishing a predetermined amount of SiN after detecting an exposed SiN layer.

SUMMARY OF THE INVENTION

The present invention has been made in view of the circumstances described above, and it is an object of the invention to provide substrate polishing apparatus which is capable of saving a manufacturing cost by preventing a reduced manufacturing yield rate due to excessive polishing and additional polishing associated with insufficient polishing, even when a high performance polishing liquid is used, and is also capable of reducing efforts in a semiconductor manufacturing process, even if the additional polishing is required, by quantitatively setting an additional polishing time, which has been conventionally determined in an empirical basis, through automatic processing within the substrate polishing apparatus.

To achieve the above object, the present invention provides a substrate polishing apparatus which includes a mechanism for polishing a substrate to be polished; a measuring apparatus for measuring the thickness of a thin film deposited on the substrate; a storage area for preserving past polishing results; and a processing unit for calculating a polishing time and a polishing rate. The substrate polishing apparatus is characterized by building an additional polishing database for storing data acquired from the result of additional polishing in the storage area.

The substrate polishing apparatus is characterized in that the processing unit optimizes a time for which polishing is conducted after receipt of a signal from a polishing process monitor disposed in the polishing mechanism, based on the data stored in the additional polishing database, for properly conducting next or subsequent polishing.

The substrate polishing apparatus is further characterized in that the processing unit is operative to calculate an optimal polishing time for the next or subsequent polishing based on the data stored in the additional polishing database.

The substrate polishing apparatus is further characterized by providing a regular polishing database in the storage area for storing data acquired from the result of regular polishing in addition to the additional polishing database. The processing unit calculates the optimal polishing time for the next polishing based on the data stored in the additional polishing database and the regular polishing database.

The substrate polishing apparatus is further characterized in that the processing unit is operative to approximately find a relational equation between a polishing amount and a polishing time from the result of polishing at two or more points stored in the additional polishing database or the regular polishing database, and to calculate the optimal polishing time based on the relational equation.

The substrate polishing apparatus is further characterized in that the substrate includes a plurality of thin films laminated thereon, and the processing unit calculates a polishing rate for at least one layer of the laminated thin films, or the ratio of polishing rates between adjacent two of the thin films, and stores the calculated polishing rate or the ratio of polishing rates in the storage area to build a database.

BRIEF DESCRIPTION OF THE DRAWINGS

FIG. 2-1 is a block diagram generally illustrating a mutual connection relationship among the components in the substrate polishing apparatus of FIG. 1;

FIG. 2-2 is a block diagram generally illustrating a mutual layout relationship among the components in the substrate polishing apparatus of FIG. 1;

DETAILED DESCRIPTION OF THE INVENTION

In the following, one embodiment of a substrate polishing apparatus according to the present invention will be described with reference to the accompanying drawings.

Figure 1:
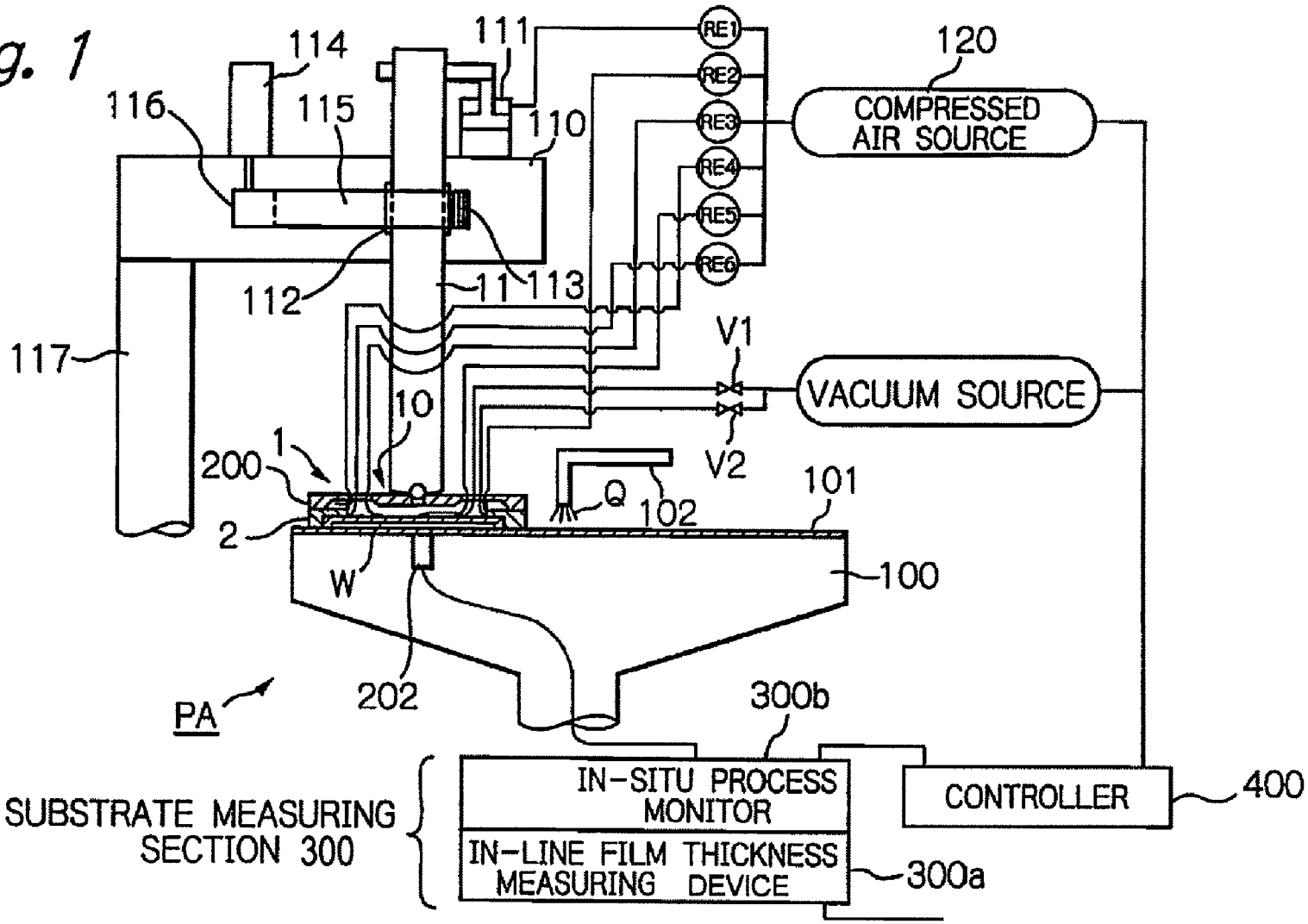
FIG. 1 is a partially cross-sectional plan view illustrating the configuration of main components of a substrate polishing apparatus according to the present invention.

FIG. 1 generally illustrates the layout and configuration of main components which make up the substrate polishing apparatus PA according to the present invention. The substrate polishing apparatus PA comprises a polishing table 100 having a polishing surface; a substrate holder 200 for holding a substrate W to be polished and pressing the substrate W onto the polishing surface of the polishing table 100; and a substrate measuring section 300 for measuring the thickness of a film formed on the substrate W as well as torques and vibrations of the substrate holder 200 and/or polishing table 200.

In FIG. 1, the substrate measuring section 300, which forms part of the substrate polishing apparatus PA, comprises an in-line film thickness measuring device 300*a* for measuring a thickness of a substrate such as a semiconductor wafer before it is polished and/or after it has undergone washing and drying processes after polishing; and an in-situ process monitor 300*b* for measuring a thickness of a substrate such as a semiconductor wafer which is being polished, and torques and vibrations of the substrate holder 200 and/or the polishing table 100. The in-line film thickness measuring device 300*a* measures the thickness of an insulating film such as a conductive Cu film, a barrier metal layer, an oxide film, and the like of a substrate W from a single or an appropriate combination of an eddy current signal generated by a sensor coil, an incident and a reflected optical signal generated by an optical means to and from the polishing surface, a signal indicative of the temperature on the polishing surface, a micro-wave reflected signal, and the like, before a carrier robot (not shown) stores the polished substrate W into a cassette (not shown) or the carrier robot has extracted an unpolished substrate W from the cassette. The in-line film thickness measuring device 300*a* also detects, from the aforementioned sensor signals and measured values, the situation and the like of the thickness and wiring of insulating layers or conductive layers of a substrate W which has been washed and dried after it has been polished, while the substrate W is maintained stationary, or while the substrate W is rested on an X-Y stage such that an arbitrary site of the substrate W, such as wiring, can be detected at a predetermined position. The in-situ process monitor 300*b* in turn detects, from the aforementioned sensor signals, measured values, or signals indicative of sensed running torques, noise, vibrations, and the like of the polishing table and substrate holder in operation, that a conductive film is removed except for necessary regions such as wiring, or an insulating film is removed during the polishing of a substrate, to determine an end point for a CMP process, such that appropriate polishing can be repeated.

The results of measurements made by the substrate measuring section 300 is communicated to a controller 400 for use in modification and the like of operation data (prescriptions) for the polishing apparatus. The condition of each polishing process in the polishing step, for example, the rotational speeds of the polishing table and top ring, the pressure, and the like, may be associated with a single or a combination of sensor outputs to measure the thicknesses of a metal film, a non-metal thick film such as an oxide film, and a thin film which are intended for polishing in each polishing step, and to detect a relative increasing/decreasing change for use in a variety of condition settings in the polishing process, for example, the detection of polishing end point. The substrate measuring section 300 can measure the thickness of each of areas defined in the radial direction of the substrate W, while a pressing force applied to each area of the substrate W by the substrate holder 200 is adjusted based on information on the thickness in each of such areas measured by the substrate measuring section 300.

As described above, the substrate holder 200 is a device for holding the substrate W to be polished, pressing the substrate W onto the polishing surface of the polishing table 100 to polish the substrate W. As illustrated in FIG. 1, the polishing table 100 having a polishing pad (polishing cloth) 101 attached to the top surface thereof is installed below the top ring 1 of the substrate holder 200, while a polishing liquid supply nozzle 102 is disposed above the polishing table 100, such that the polishing liquid supply nozzle 102 supplies a polishing liquid Q onto the polishing pad 101 on the polishing table 100.

The top ring 1 is connected to a top ring driving shaft 11 through a free joint 10, and the top ring driving shaft 11 is coupled to a top ring air cylinder 111 fixed to a top ring head 110. The top ring driving shaft 11 is moved up and down by the top ring air cylinder 111 to elevate the overall top ring 1 and to press a retainer ring 2 fixed at a lower end of the top ring 1 onto the polishing table 100. The top ring air cylinder 111 is connected to a compressed air source 120 through a regulator RE1, such that the regulator RE1 can adjust a fluid pressure such as an air pressure of a pressurized air supplied to the top ring air cylinder 111. In this way, a pressing force applied by the retainer ring 2 to press the polishing pad 101 can be adjusted.

The top ring driving shaft 11 is coupled to a rotary cylinder 112. The rotary cylinder 112 has a timing pulley 113 on the outer periphery thereof. A top ring motor 114 is fixed to the top ring head 110, and the timing pulley 113 is connected to a timing pulley 116 disposed for the top ring motor 114 through a timing belt 115. Therefore, as the top ring motor 114 is driven for rotation, the rotary cylinder 112 and top ring driving shaft 11 integrally rotate for upward and downward movements through the timing pulley 116, timing belt 115 and timing pulley 113, eventually causing the top ring 1 to rotate. The top ring head 110 is supported by a top ring head shaft 117 which in turn is securely supported by a frame (not shown).

For polishing a substrate W, the substrate W is fixed on the bottom surface of the top ring 1, and the top ring air cylinder 111 coupled to the top ring driving shaft 11 is actuated to press the retainer ring 2 fixed at the lower end of the top ring 1 onto the polishing surface of the polishing table 100 with a predetermined pressing force. In this state, pressurized air at a predetermined pressure is supplied into the retainer ring 2 from the compressed air source 120 through regulators RE2-RE6 to press the substrate W onto the polishing pad 101 of the polishing table 100. Simultaneously, the polishing liquid Q is fed from the polishing liquid supply nozzle 102 to hold the polishing liquid Q in the polishing pad 101, such that the substrate W is polished with the polishing liquid Q interposed between the polished surface of the substrate W and the polishing pad 101.

On the substrate W, a copper plate film is deposited in a groove created in an $SiO_2$ film for forming certain wiring, and a barrier layer has been deposited as an underlying material therefor. When an insulating film such as an $SiO_2$ film has been deposited on the top layer of the substrate W, the thickness of the insulating film is sensed by an in-line film thickness measuring device such as an optical sensor, a microwave sensor or the like for removing the insulating film. A light source for the optical sensor used herein may be a halogen lamp, a xenon flash lamp, LED, a laser light source, and the like. On the other hand, a conductive film such as a copper film, a tungsten film and the like is to be polished, an eddy current sensor may be used in addition to the aforementioned optical sensors. Also, from the fact that the polishing table and top ring change in their torques and vibrations when a material to be polished changes, for example, when a conductive film has been substantially removed to expose a barrier layer, a polishing end point can be determined by sensing the torques and vibrations of the polishing table and top ring.

In the substrate polishing apparatus PA, the controller 400 controls the polishing processing on the surface of the substrate W, while the substrate measuring section 300 measures the thickness of a film to be polished.

Figures 1, 2:
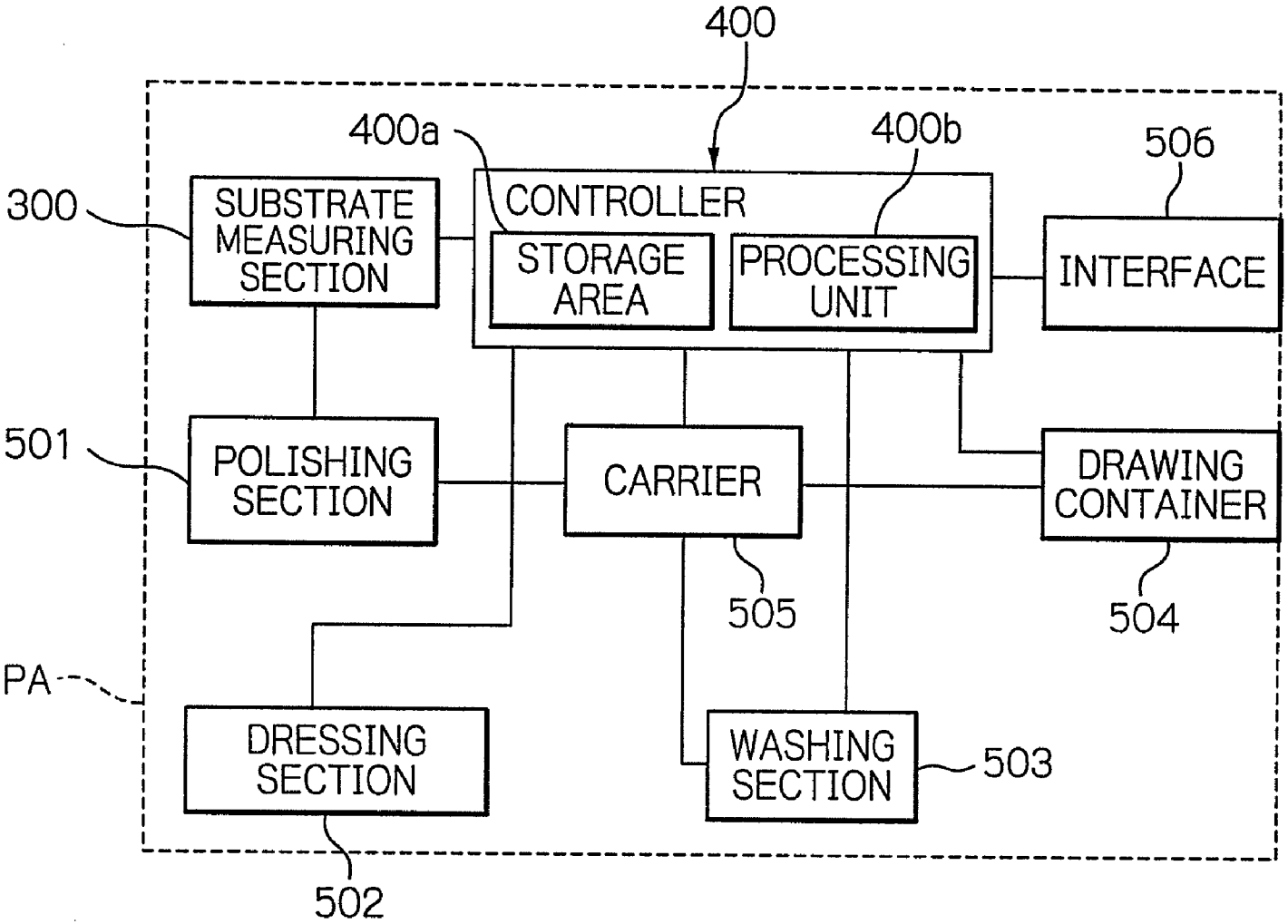
Figure 2:
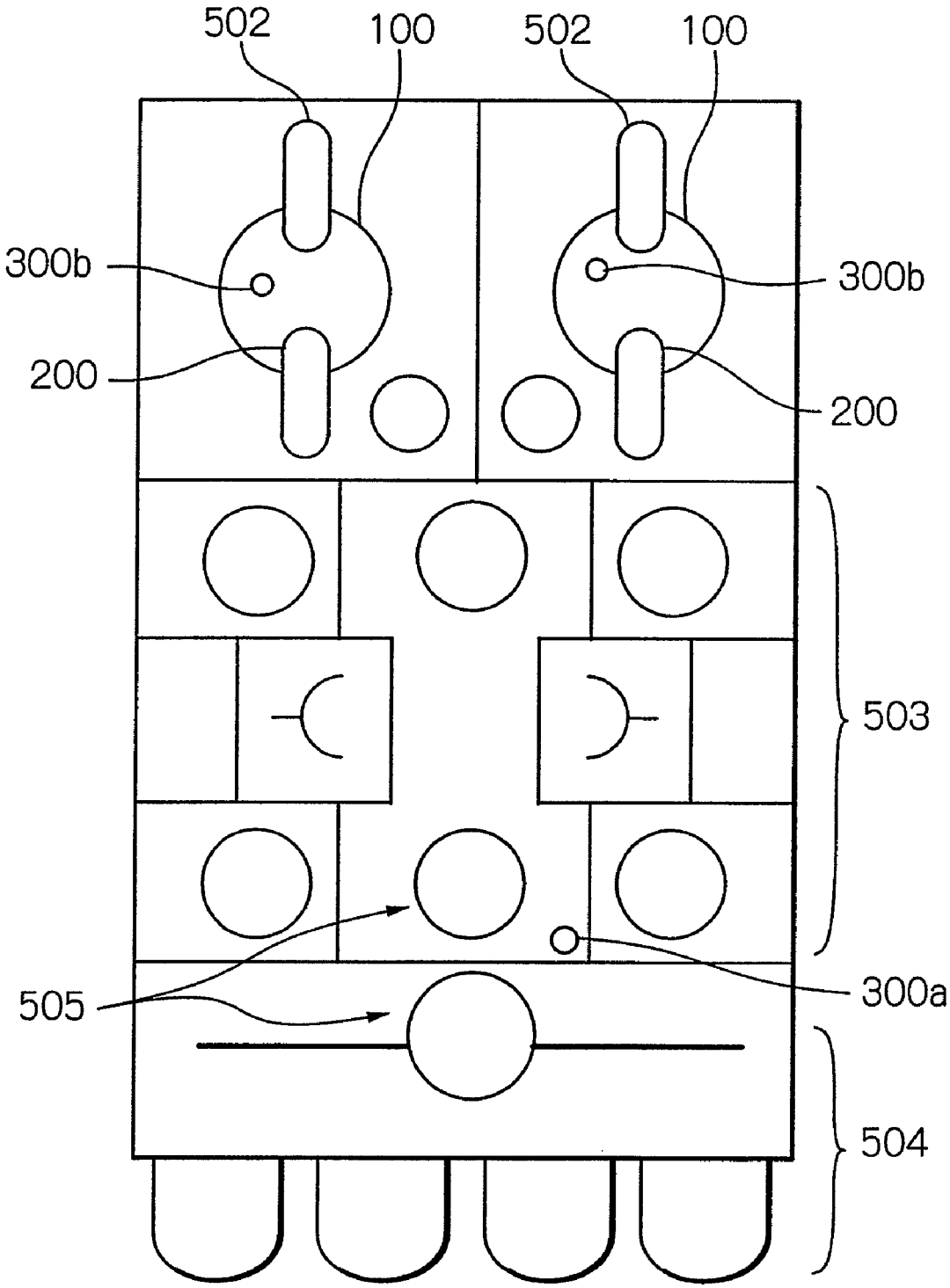

FIG. 2-1 is a diagram illustrating a mutual connection relationship among the respective components of the substrate polishing apparatus PA. FIG. 2-2 is a diagram illustrating a mutual layout relationship among the respective components of the substrate polishing apparatus PA. In these figures, the substrate polishing apparatus PA comprises a polishing section 501 including the polishing table 100 for polishing a substrate W which is to be polished, and the substrate holder 200; a dressing section 502 for dressing the polishing surface of the polishing table 100; a washing section 503 for washing and drying the polished substrate W; a drawing container 504 for loading an unpolished substrate W from a cassette and unloading a polished substrate to the cassette; a carrier 505; the substrate measuring section 300; and the controller 400.

A substrate W extracted from a cassette in the drawing container 504 is fed to the polishing section 500 by the carrier 505. During a period of polishing, the substrate measuring section 300 sends data on the thickness of the substrate W before polishing, during polishing and after polishing to the controller 400 for storage in a storage area 400*a*. The controller 400 also comprises a processing unit 400*b* for calculating a polishing time. The processing unit 400*b* calculates a polishing rate from the amount of polished film and a polishing time after the end of polishing, for example, by use of a weighted average method, and stores the calculated polishing rate in the storage area 400*a*. Therefore, each time a substrate W has been polished in the polishing apparatus PA, data such as the amount of removed film and polishing time are preserved in the storage area 400*a*, and the polishing rate is calculated by the processing unit 400*b* and preserved again in the storage area 400*a*. Further, a variety of data are input and output between an operator and the controller 400 through an interface 506. For example, the operator can store a target thickness after polishing in the storage area 400*a* of the controller 400 through the interface 506.

Assuming that an optical film thickness measuring device is employed for the in-situ process monitor 300*b*, when the thickness of a film on a substrate W to be polished is measured by the optical film thickness measuring device making use of incident light to and reflected light from a polishing surface, the reflected light received by and reflected from the polishing surface is converted into a characteristic value, and a maximum value and minimum value of a temporal change in the characteristic value are detected to know how the polishing is advanced. Likewise, when the in-situ process monitor 300*b* measures a running torque of the top ring 1 or polishing table 100, or when an eddy current sensor, a vibration sensor, or an acoustic sensor is used, a predetermined maximum value, minimum value or threshold is detected to know how the polishing is advanced. In this event, if the polishing is stopped at the time the maximum value or minimum value is detected, and the thickness is previously measured for reference, the progress of the polishing can be associated with the thickness of a polished film. In the detection of a polishing stop point or an end point such as a polishing change point, an extreme value (one of characteristic points) immediately before a desired thickness is detected, and a film is polished after the detection of the extreme value for a time corresponding to the difference between a thickness associated with the extreme value and the desired thickness. In the following description, a polishing time after the detection of the extreme value is called "over-polish."

Next, characteristic operational modes of the substrate polishing apparatus PA according to the present invention will be described in connection with STI CMP which is given as an example.

Figure 3:
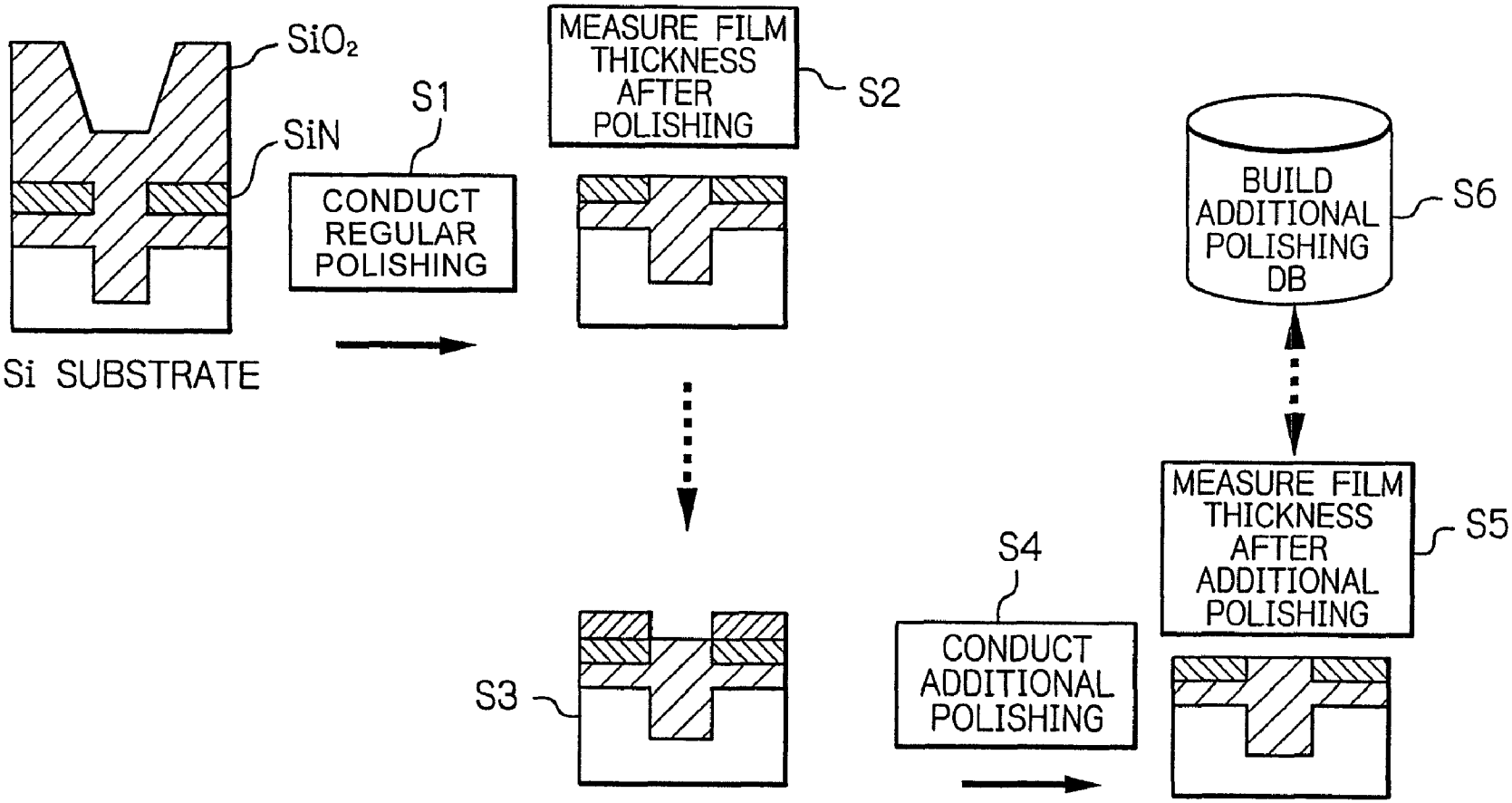
FIG. 3 is a flow diagram for describing a first operational mode of the substrate polishing apparatus according to the present invention.

FIG. 3 is a flow diagram illustrating a procedure in a first operational mode of the substrate polishing apparatus PA according to the present invention, wherein at the time additional polishing is required, the result of the additional polishing is registered in the storage area 400*a* for building an additional polishing database (hereinafter called the "additional polishing DB"). In FIG. 3, a substrate W, which is formed with a $SiO_2$ film on the top, and an underlying SiN layer, is held by the substrate holder 200, and is polished as normally done at step S1. During the polishing, a thickness on the polishing surface is sequentially measured by the in-situ process monitor 300*b*. When the in-situ process monitor 300*b* senses an extreme value immediately before a predetermined or desired thickness at step S2, the substrate W is over-polished before the polishing is completed. Subsequently, if it is found by the in-line film thickness measuring device 300*a* at step S3 that there is unfinished polishing portion in the $SiO_2$ film, the controller 400 instructs the substrate polishing apparatus PA to rework, i.e., additionally polish the $SiO_2$ film at step S4. At the end of the additional polishing, the in-situ process monitor 300*b* is again instructed to measure the thickness at step S5. In such a process, data such as the thickness of the additionally polished film, a time required for the additional polishing, an additional polishing rate, and the like can be acquired and sent to the controller 400 for storage in the storage area 400*a*. In this way, the additional polishing DB is built in the storage area 400*a*.

Figure 4:
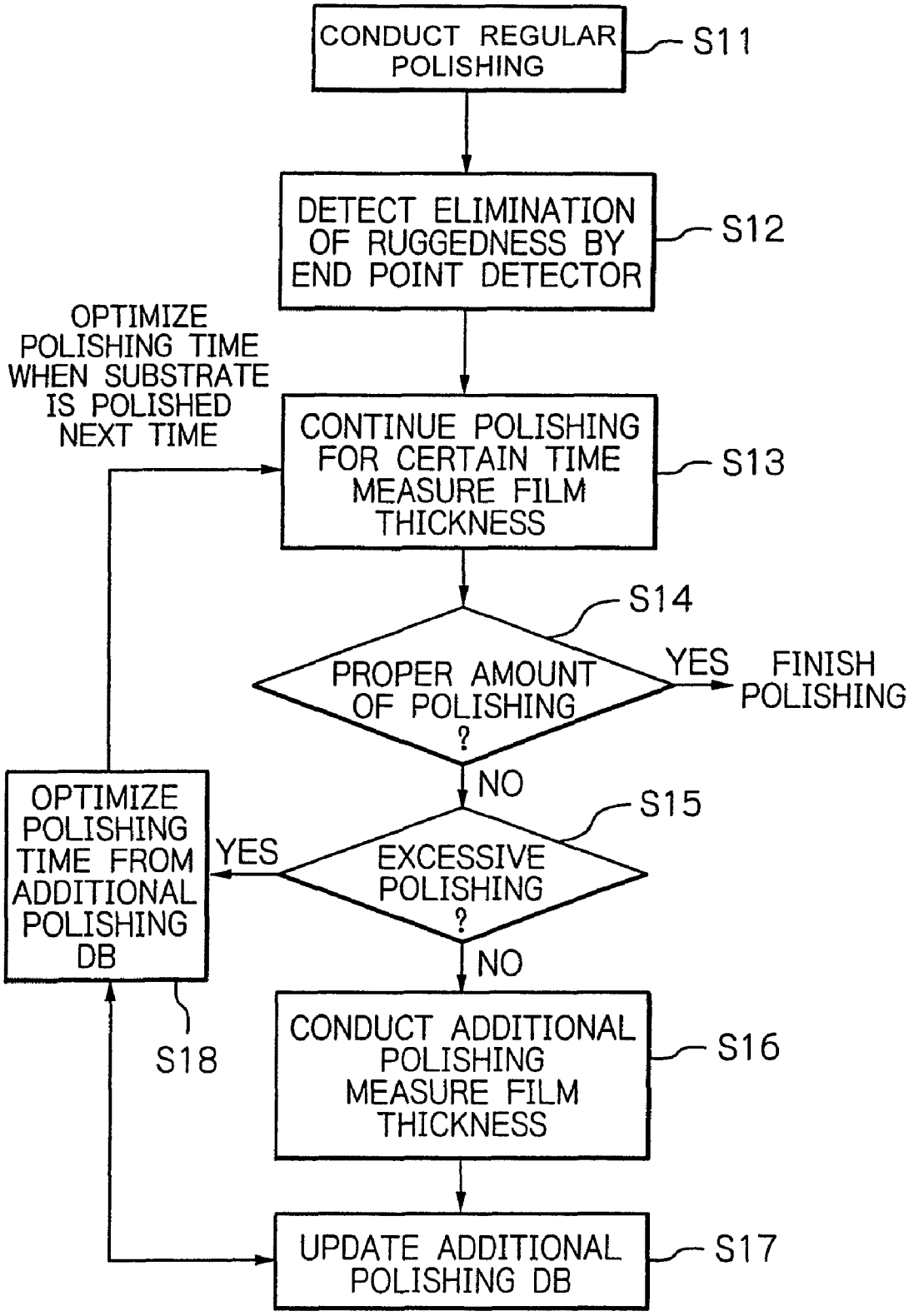
FIG. 4 is a flow diagram for describing a second operational mode of the substrate polishing apparatus according to the present invention.

FIG. 4 is a flow diagram illustrating a procedure in a second operational mode of the substrate polishing apparatus PA according to the present invention, with the intention of optimizing an over-polishing time based on the additional polishing DB. In FIG. 4, a substrate W held by the substrate holder 200 is polished as normally done at step S11, and upon detection of an extreme value immediately before a predetermined thickness of the substrate W by a signal from the in-situ process monitor 300*b* at step S12, the controller 400 forces the substrate polishing apparatus PA to continue the polishing further for a predetermined time (over-polishing time) at step S13 to conduct the over-polishing. After the polishing is completed, the controller 400 instructs the in-line film thickness measuring device 300*a* to measure the thickness on the polishing surface of the polishing table 100. Next, the controller 400 determines at step S14 whether or not the amount of polishing is appropriate, and finishes the polishing when the amount of polishing is appropriate, in which case the polishing condition stored in the additional polishing DB is not modified.

On the other hand, when the amount of polishing is not appropriate as determined at step S14, the controller 400 determines at step S15 whether or not the polishing is excessive. When the polishing is not excessive as determined at step S15, the over-polishing time should be extended, so that the controller 400 forces the substrate polishing apparatus PA to conduct additional polishing at step S16, and instructs the in-situ process monitor 300*b* to again measure the thickness at the time the controller 400 knows through a signal from the substrate measuring section 300 that the additional polishing is finished. In such a process, data such as the thickness of the polished film, a time required for the polishing, an additional polishing rate, and the like, acquired at steps S13-S16, are sent to the controller 400 at step S17. The controller 400 updates the additional polishing DB in the storage area 400*a* based on the data sent thereto. Based on the data stored in the thus updated additional polishing DB, the processing unit 400*b* of the controller 400 performs optimization for extending the over-polishing time at step S18, and registers the optimized over-polishing time in the additional polishing DB. This optimized over-polishing time is used to conduct the next polishing.

When the polishing is excessive as determined at step S15, the over-polishing time at step S13 should be reduced, so that the controller 400 performs optimization at step S18 to reduce the over-polishing time based on the data stored in the additional polishing DB, and registers the reduced over-polishing time in the additional polishing DB for use in the next polishing.

Figure 5:
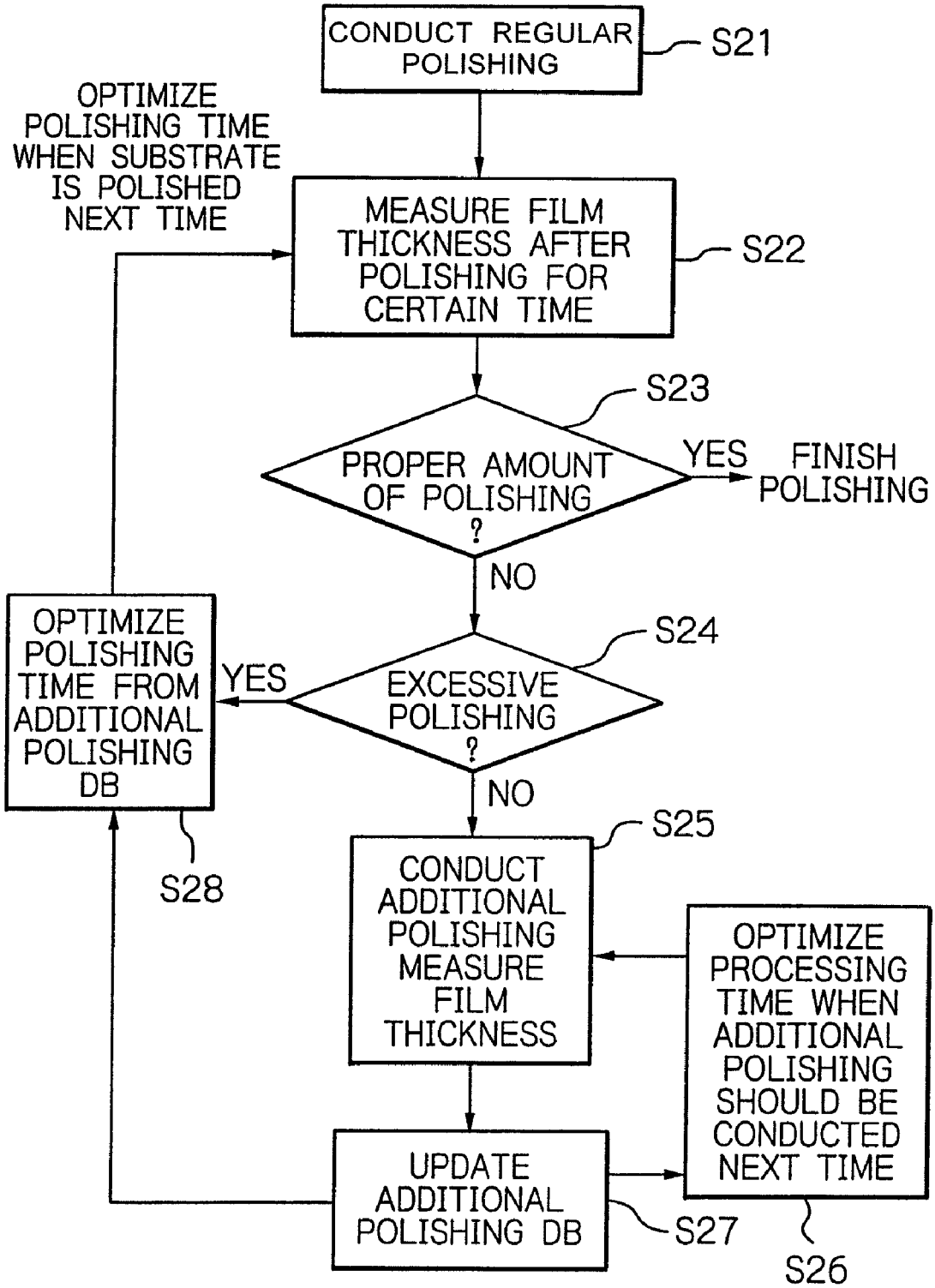
FIG. 5 is a flow diagram for describing a third operational mode of the substrate polishing apparatus according to the present invention.

FIG. 5 is a flow diagram illustrating a procedure of a third operational mode of the substrate polishing apparatus PA according to the present invention, wherein an optimal polishing time is calculated for the next polishing (including the additional polishing) based on the additional polishing DB. In FIG. 5, a substrate W held by the substrate holder 200 is polished as normally done at step S21, and upon detection of the lapse of a predetermined time at step S22, the controller 400 instructs the substrate measuring section 300 to measure the thickness on the polished surface of the substrate W. Then, the controller 400 determines at step S23 whether or not the amount of polishing is appropriate, and finishes the polishing and does not modify the polishing condition stored in the additional polishing DB when the amount of polishing is appropriate.

On the other hand, when the amount of polishing is not appropriate as determined at step S23, the controller determines at step S24 whether or not the polishing is excessive. When the polishing is not excessive as determined at step S23, the over-polishing time should be extended, so that the controller 400 forces the substrate polishing apparatus PA to conduct additional polishing at step S24, and instructs the in-line film thickness measuring device 300*a* to again measure the thickness at the time the controller 400 knows through a signal from the in-situ process monitor 300*b* that the additional polishing is finished. In such a process, data such as the thickness of the polished film, a time required for the polishing, an additional polishing rate, and the like, acquired at steps S22-S25, are sent to the controller 400. Then, the processing unit 400*b* of the controller 400 calculates at step S26 an optimal polishing time for the additional polishing which can next occur, and updates the additional polishing DB with the calculated optimal polishing time at step S27. Thus, in the next polishing, the processing unit 400*b* of the controller 400 performs the processing for optimizing the polishing time based on the data stored in the updated additional polishing DB at step S28, so that the next polishing is conducted at step S22 with the optimized polishing time.

When the polishing is excessive as determined at step S24, the polishing time at step S22 should be reduced, so that the processing unit 400*b* of the controller 400 performs optimization for reducing the polishing time based on the data stored in the additional polishing DB, and registers the reduced polishing time in the additional polishing DB for use in the next polishing.

Figure 6:
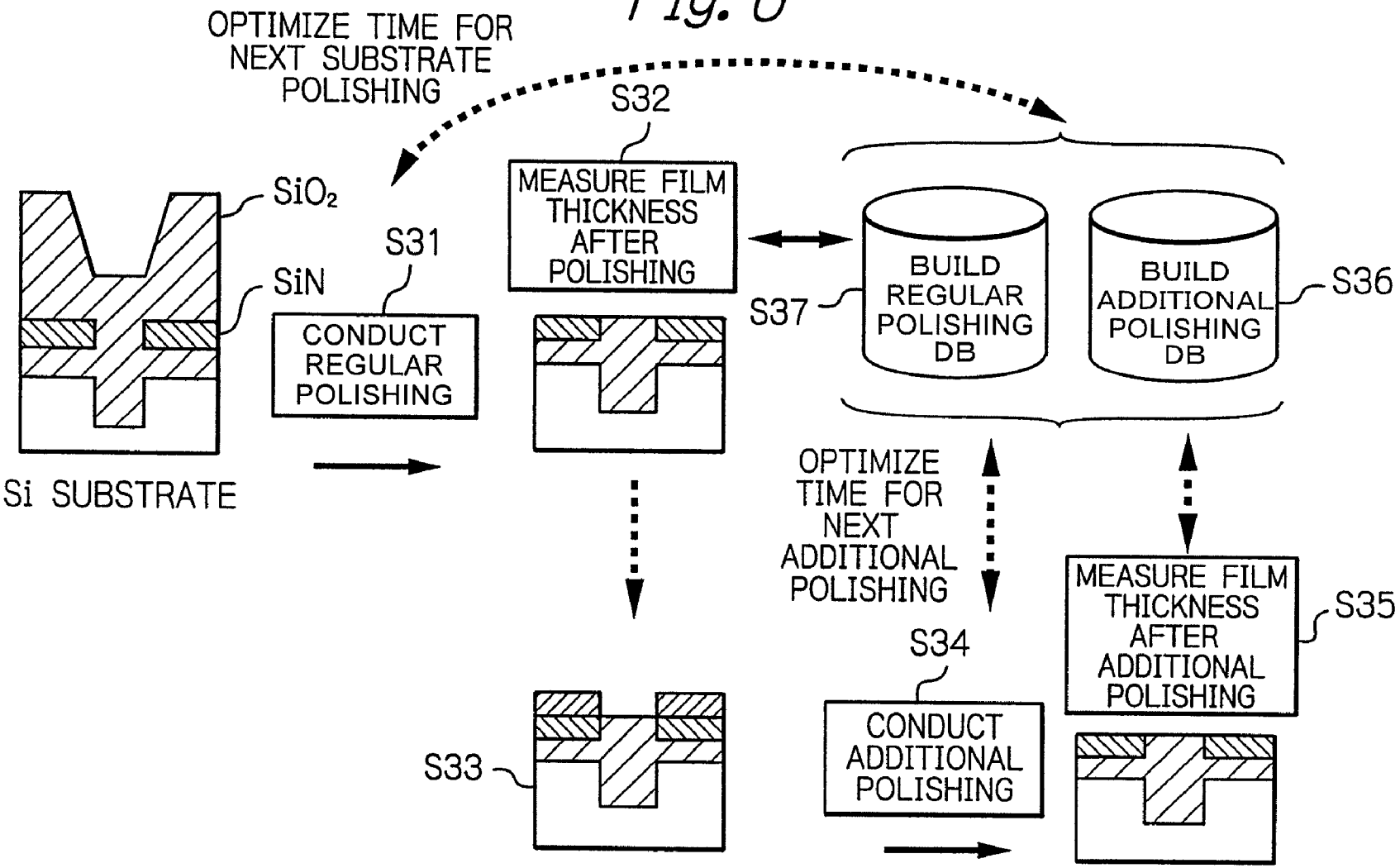
FIG. 6 is a flow diagram for describing a fourth operational mode of the substrate polishing apparatus according to the present invention.

FIG. 6 is a flow diagram illustrating a procedure in a fourth operational mode of the substrate polishing apparatus PA according to the present invention. In addition to the additional polishing DB described in connection with FIG. 3, a regular polishing data base (hereinafter called the "regular polishing DB") for storing data related to regular polishing is built in the storage area 400*a*, such that an optimal polishing time is calculated for the next polishing (including additional polishing) using these databases. In FIG. 6, a substrate W is held by the substrate holder 200 and is polished as normally done at step 31. During the polishing, the thickness is sequentially measured on the polishing surface of the polishing table 100 by the in-situ process monitor 300*b*, and as the in-situ process monitor 300*b* senses an extreme value immediately before a desired thickness at step S32, the substrate polishing apparatus PA conducts over-polishing before the polishing is finished.

As a result of the measurement of the thickness at step S32, if the in-line film thickness measuring device 300*a* finds an unfinished polishing portion in an $SiO_2$ film at step S33, the controller 400 instructs the substrate polishing apparatus PA to conduct additional polishing at step S34, and forces the in-line film thickness measuring device 300*a* to again measure the thickness at step S35. In such a process, data such as the thickness of additionally polished film, a time required for the additional polishing, an additional polishing rate, and the like can be acquired and sent to the controller 400 for storage in the storage area 400*a* at step S36. In this way, the additional polishing DB is built in the storage area 400*a*. In addition, data such as the thickness of the polished film, a time required for the polishing, the polishing rate, and the like, acquired through the regular polishing conducted at steps S31, S32, are also sent to the controller 400 for storage in the storage area 400*a* at step S37. In this way, the regular polishing DB is built in the storage area 400*a*. Based on the regular polishing DB and additional polishing DB thus built in the storage area 400*a*, the processing unit 400*b* calculates an optimal regular polishing time and an optimal additional polishing time for a substrate which is to be next polished.

Figure 7B:
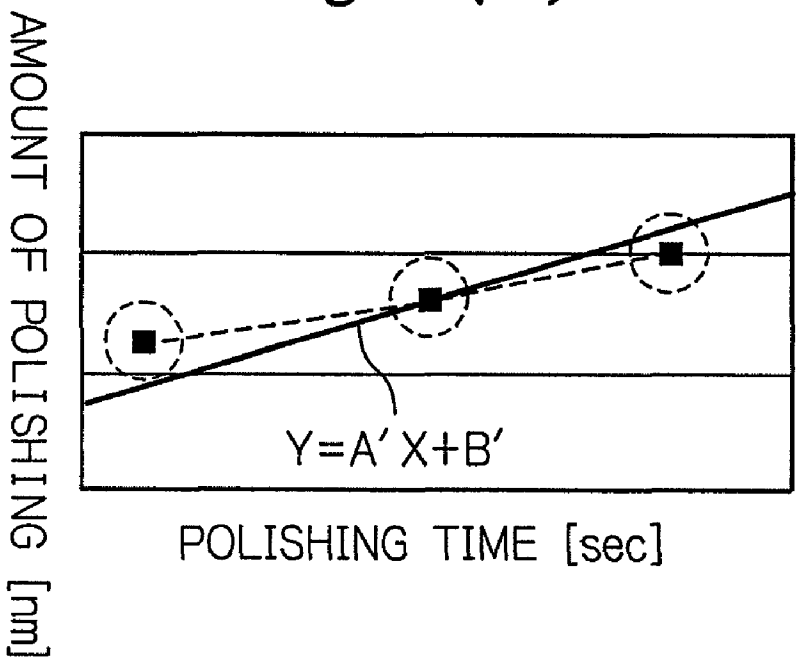
FIGS. 7(A) and 7(B) are graphs for describing a fifth operational mode of the substrate polishing apparatus according to the present invention.
Figure 7A:
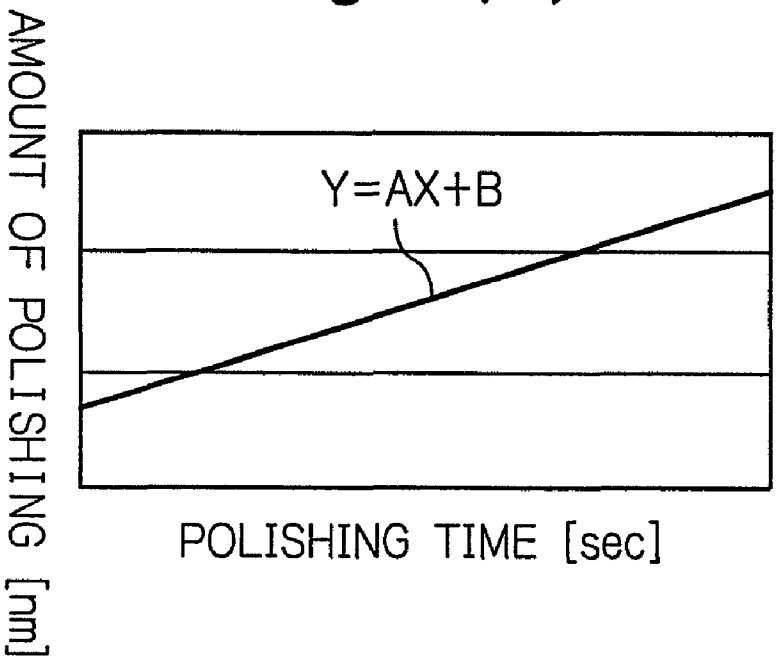
Figure 8:
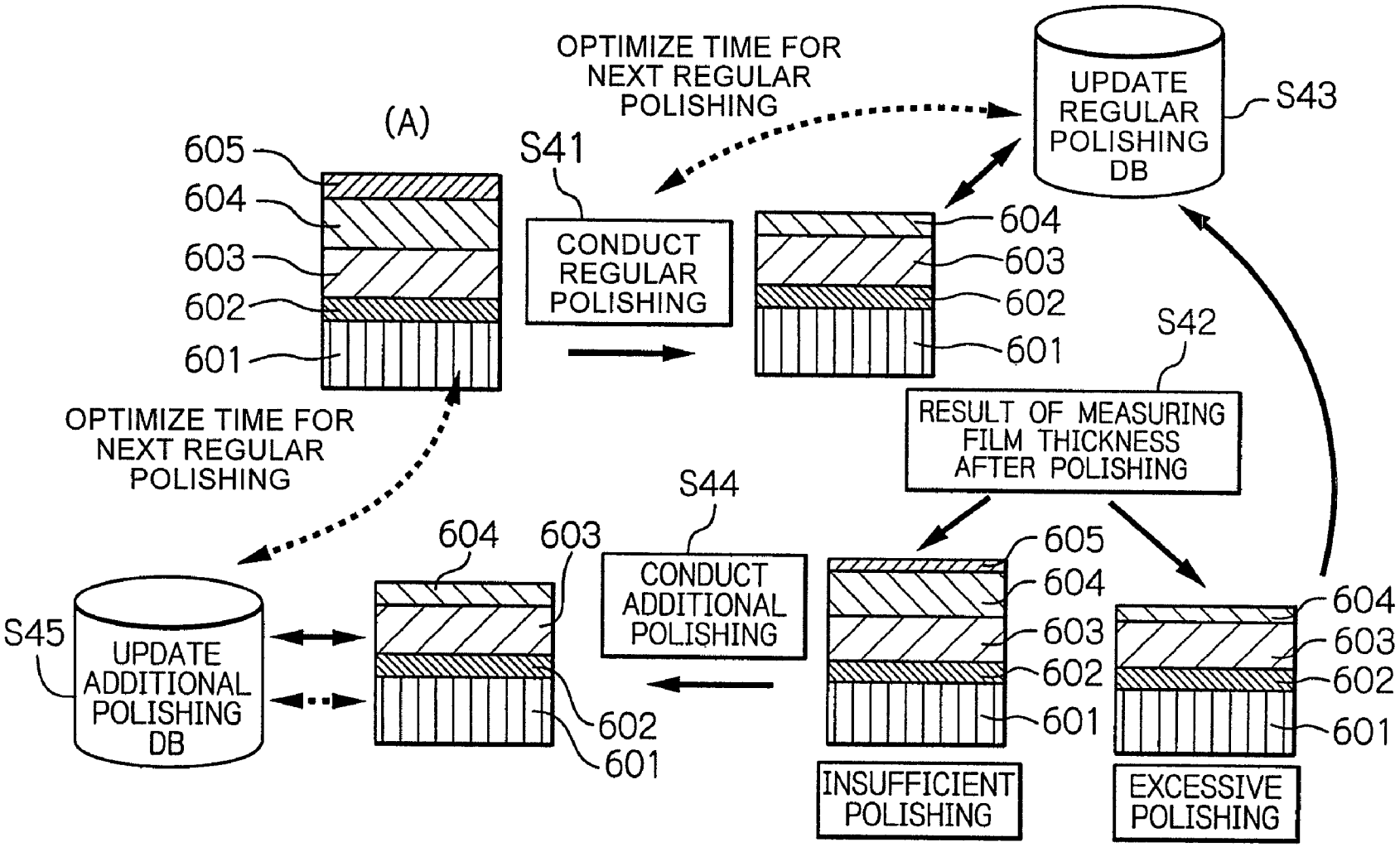
FIG. 8 is a diagram for describing an operational mode when the substrate polishing apparatus according to the present invention is applied to another substrate.

A fifth operational mode of the substrate polishing apparatus PA according to the fifth embodiment calculates an optimal polishing time making use of the regular polishing DB and additional polishing DB which have been described in connection with FIG. 6. Assume, for example, that polishing is conducted on the assumption that the relationship between the amount of polishing and a polishing time is expressed by an approximate equation Y=AX+B shown in FIG. 7(A), but when actual amounts of polishing and polishing times stored in the regular polishing DB or additional polishing DB are plotted, a linear relationship is found as indicated by a dotted line in FIG. 7(B). Thus, the processing unit 400*b* of the controller 400 modifies the coefficients A, B in the default approximate equation Y=AX+B, sets a new relationship between the amount of polishing and the polishing time as expressed by Y=A'X+B', and calculates an optimal polishing time using this equation.

A sixth operational mode of the substrate polishing apparatus PA according to the present invention calculates a polishing rate for at least one layer or a polishing rate for each of laminated layers, when polishing a substrate having a plurality of thin layers of different film types laminated thereon, to build a database with the calculated rates. In the sixth operational mode of the present invention, after completely removing an $SiO_2$ film deposited as the topmost layer of a substrate, an underlying SiN layer is polished by a predetermined thickness, followed by finish of the polishing.

In this event, during the polishing of a substrate having a plurality of different types of films laminated thereon, the processing unit 400*b* of the controller 400 calculates the thickness of each of polished films in the laminate, a polishing rate in at least one film, and the ratio of the polishing rates of an overlying layer to an underlying layer, and stores the results of the calculations in the storage area 400*a* for building a database. Using the data thus formed into a database, for example, when an unfinished polishing portion is found in the $SiO_2$ layer after the regular polishing, an end timing for the polishing for removing the remaining $SiO_2$ film can be calculated by:

$$\text{Polishing Rate of } SiO_2 = [(\text{IniThk_1} - \text{PostThk_1}) + (\text{IniThk_2} - \text{PostThk_2}) \times RR_1/RR_2]/T \quad \text{[Equation 1]}$$

where:

T is an additional polishing time;

IniThk_1 is the thickness of the $SiO_2$ film before the additional polishing;

PostThk_1 is the thickness of the $SiO_2$ film after the additional polishing;

IniThk_2 is the thickness of the SiN layer before the additional polishing;

PostThk_2 is the thickness of the SiN layer after the additional polishing;

RR_1 is an average polishing rate of the $SiO_2$ film; and

RR_2 is an average polishing rate of the SiN film.

In a polishing process for polishing a plurality of types of films, it has been empirically found that though the absolute polishing rate differs from one film to another depending on the rotational speed of the top ring, the degree of abrasion on the polishing surface of the polishing table 100, and the like, the ratio of the polishing rates from one different film to another, i.e., the average polishing rate ratio (RR_1/RR_2) in the foregoing equation is generally constant.

While the foregoing description has been made in connection with STI CMP given as an example, the substrate polishing apparatus according to the present invention can be applied to Cu CMP as well. For example, when the substrate polishing apparatus according to the present invention is used to polish a barrier metal layer 605 and a second insulating film 604 in a substrate on which a first insulating film 602, a low-k film 603, the second insulating film 604, and the barrier metal layer 605 are laminated in this order on a Cu film 601, the substrate can be polished in a similar procedure to that previously described with reference to FIG. 6. Specifically, first at step S41, after regular polishing is conducted for a predetermined time, or after removal of the barrier metal layer 605 is sensed by an eddy current sensor or the like, over-polishing is conducted for a predetermined time before the polishing is finished. At the time the polishing is finished, the thickness after the polishing is measured by the in-line film thickness measuring device 300*a* at step S42. When the result shows an appropriate amount of polishing, the regular polishing DB is updated at step S43 with data related to the current polishing to optimize the next regular polishing time. On the other hand, when the polishing is excessive at step S42, the regular polishing DB is updated at step S43. When insufficient polishing is detected at step S42, the additional polishing is conducted at step S44, and the additional polishing DB is updated at step S45 after the end of the additional polishing to optimize the next additional polishing time.

While one embodiment of the substrate polishing apparatus according to the present invention and several operational modes thereof have been described above, it should be understood that the present invention is not limited to the foregoing embodiment but may be practiced in a variety of different manners within the technical concept of the invention. Also, the substrate polishing apparatus and its exemplary configuration are not limited to the foregoing illustrative examples, but a variety of modifications can be made thereto without departing from the spirit and scope of the invention, as a manner of course.

For example, while the substrate polishing apparatus has been described as comprising both the in-line film thickness measuring device and in-situ process monitor, the present invention can be practiced even when the substrate polishing apparatus comprises the in-line film thickness measuring device alone. Specifically, when the polishing process is controlled in terms of time, and a substrate is measured by the in-line film thickness measuring device after it has been polished for a fixed time, the in-line film thickness measuring device senses insufficient polishing or excessive polishing, and additional polishing is conducted if the insufficient polishing is sensed. Alternatively, when a polishing situation is detected by sensing a current of a motor for driving the substrate holder or polishing table, a threshold for a sensed motor current can be adjusted as well by building the additional polishing DB using the in-line film thickness measuring device.

The substrate polishing apparatus according to the present invention can also be applied to a QC (quality control) wafer. The QC wafer refers to a wafer for periodically checking a polishing rate and substrate in-plane uniformity, such as once a week, once a day, or every 100 wafers, and the like. Basically, the QC wafer has a predetermined material to be polished, such as a copper film, an insulating film, or the like, uniformly formed on the surface of the substrate. Assuming that the polishing of the QC wafer is similar to the additional polishing, the result of the polishing can be reflected to the additional polishing DB. The additional polishing is generally conducted when steps in the surface under polishing formed on the substrate have been eliminated so that the surface of the substrate has become substantially uniform. In other words, the additional polishing is common to the QC wafer polishing in that a uniform surface under polishing is polished, so that the result of polishing the QC wafer can be reflected to the additional polishing DB. In this way, in a polishing apparatus which has not conducted the additional polishing, such as a polishing apparatus in its initial operation, the result of polishing the QC wafer can be replaced with the additional polishing to improve the accuracy for conditions set for actual additional polishing.

As will be understood from the foregoing description, the present invention provides particular advantages including:

- the ability to prevent a lower manufacturing yield rate due to excessive polishing;
- a reduction in the manufacturing cost by preventing requirements for additional polishing due to insufficient polishing; and
- a reduction in efforts in a semiconductor manufacturing process by quantitatively setting an additional polishing time.

What is claimed is:

1. A polishing method, comprising:

polishing a substrate having a layer deposited on a surface of the substrate in a regular polishing process, said regular polishing process comprising polishing the substrate until an in-situ process monitor senses predetermined layer thickness of the substrate and, then, over-polishing the substrate for a predetermined time which corresponds to a difference between a desired layer thickness and the predetermined layer thickness sensed by said in-situ process monitor;

measuring a layer thickness of the substrate after said regular polishing process as a first thickness using an in-line film thickness measuring device to detect an unfinished polishing portion;

polishing the substrate in an additional polishing process to remove the unfinished polishing portion of the layer if said in-line film thickness measuring device detects the unfinished polishing portion;

measuring a layer thickness of the polished substrate after said additional polishing process as a second thickness with said in-line film thickness measuring device;

calculating a polishing rate of said additional polishing process from said first thickness, said second thickness and an amount of polishing time of said additional polishing process;

storing a database with first data that comprises at least one of the layer thickness, the polishing time and the polishing rate of said additional polishing process; and extending an over-polishing time, based on the first data, used to polish a subsequent substrate.

2. The polishing method of claim 1, and further comprising:

storing the database with second data that comprises at least one of a layer thickness, a polishing time and a polishing rate in said regular polishing process.

3. The polishing method of claim 2, and further comprising:

optimizing an amount of polishing time in said regular polishing process based on said first data and said second data as a polishing time of the subsequent substrate.

4. The polishing method of claim 3, and further comprising:

calculating a relational equation between a polishing amount and a polishing time from two or more points stored in said database.

5. A polishing method, comprising:

polishing a substrate having a layer deposited on a surface of the substrate in a regular polishing process, said regular polishing process comprising polishing the substrate until an in-situ process monitor senses a predetermined layer thickness of the substrate, and then over-polishing the substrate for a predetermined time which corresponds to a difference between a desired layer thickness and the predetermined layer thickness sensed by said in-situ process monitor;

measuring a layer thickness of the substrate after said regular polishing process as a first thickness using an in-line film thickness measuring device and detecting an unfinished polishing portion;

polishing the substrate in an additional polishing process to remove the unfinished polishing portion of the layer;

measuring a layer thickness of the polished substrate after said additional polishing process as a second thickness with said in-line film thickness measuring device;

calculating a polishing rate of said additional polishing process from said first thickness, said second thickness and an amount of polishing time of said additional polishing process;

storing a database with first data that comprises at least one of the layer thickness, the polishing time and the polishing rate of said additional polishing process; and polishing a subsequent substrate in said regular polishing process with an extended over-polishing time that is extended based on the first data.

6. The polishing method of claim 5, and further comprising:

storing the database with second data that comprises at least one of a layer thickness, a polishing time and a polishing rate in said regular polishing process.

7. The polishing method of claim 6, and further comprising:

optimizing an amount of polishing time in said regular polishing process based on said first data and the second data as a polishing time for the subsequent substrate.

8. The polishing method of claim 7, and further comprising:

calculating a relational equation between a polishing amount and a polishing time from two or more points stored in said database.

* * * * *